US007030329B1

(12) United States Patent
Sneek et al.

(10) Patent No.: US 7,030,329 B1
(45) Date of Patent: Apr. 18, 2006

(54) SWITCH CONTACT

(75) Inventors: Brian Sneek, Markham (CA); Gary Warren, Aurora (CA); Simon Chamuczynski, Scarborough (CA); Reginald Grills, Oshawa (CA)

(73) Assignee: Solectron Invotronics, Scarborough (CA)

( * ) Notice: Subject to any disclaimer, the term of this patent is extended or adjusted under 35 U.S.C. 154(b) by 0 days.

(21) Appl. No.: 10/969,965

(22) Filed: Oct. 22, 2004

(51) Int. Cl.
*H01H 1/06* (2006.01)

(52) U.S. Cl. ..... 200/292; 200/512; 200/517

(58) Field of Classification Search ..... 200/512, 200/513, 516, 517, 292, 16 R, 16 B, 275
See application file for complete search history.

(56) References Cited

U.S. PATENT DOCUMENTS 4,536,625 A * 8/1985 Bebie ..... 200/5 A
4,652,704 A * 3/1987 Franklin ..... 200/5 A
4,892,981 A * 1/1990 Soloway et al. ..... 200/5 A
5,559,311 A * 9/1996 Gorbatoff ..... 200/513
5,810,604 A * 9/1998 Kopp et al. ..... 200/5 A
5,834,714 A * 11/1998 Berger et al. ..... 200/5 A
6,603,086 B1 * 8/2003 Kawaguchi et al. ..... 200/517

* cited by examiner

*Primary Examiner*—Michael A Friedhofer
(74) *Attorney, Agent, or Firm*—Patton Boggs LLP

(57) ABSTRACT

A conducting contact pair for a switch has a first conducting contact formed by a plurality of outward extending radial fingers arranged on a substrate, and a second conducting contact formed by a plurality of inward extending radial fingers. The first conducting contact and the second conducting contact are arranged with each inward extending radial finger extending between a corresponding pair of adjacent outward extending radial fingers. A bridge conductor is selectively pressed against the first conducting contact and the second contact to bridge any of the inward extending fingers to either of pair of adjacent outward extending radial fingers that it extends between.

20 Claims, 7 Drawing Sheets

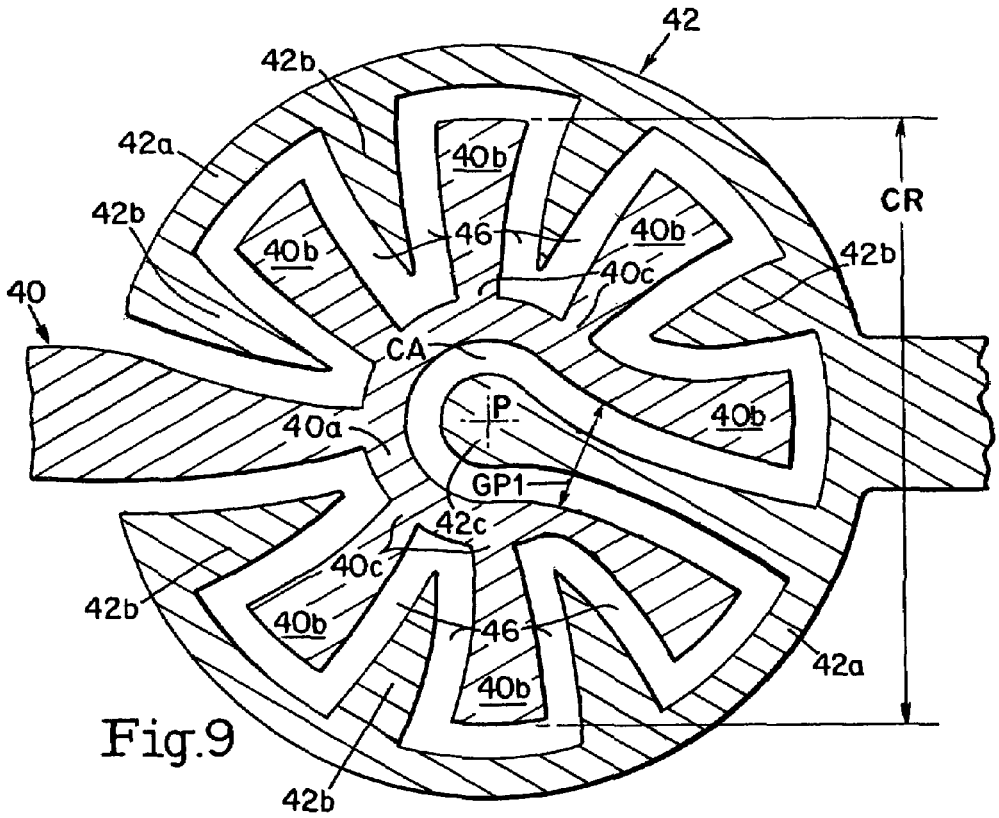
Fig.9
Fig.12
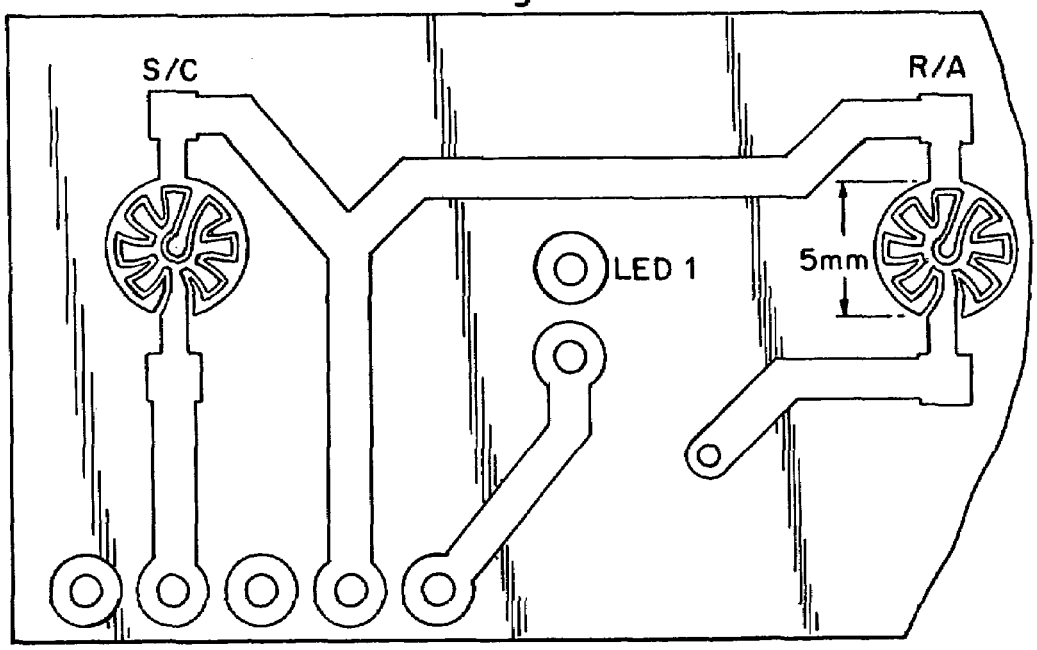

SWITCH CONTACT

FIELD OF THE INVENTION

This invention relates generally to an electrical switch contacts and, more particularly, to a pattern of electrical contacts arranged on a substrate in association with a movable bridge contact.

DESCRIPTION OF THE RELATED ART

Plunger-activated electrical switches, commonly referred to as "push button" switches, are used in association with, and are mounted on and in, a wide variety of consumer appliances, vehicles, medical equipment, military and industrial equipment. The function of a push button switch is, generally, to open and close an electrical path between at least one-input terminal of the switch and at least one output terminal of the switch. Typically the electrical path permits the flow of an electrical current, thereby energizing, or activating or deactivating a feature of, or changing a mode of operation of an electrical apparatus. There are many known structures for push button switches. A typical structure includes a first conducting contact, a second conducting contact, and a movable bridge conductor which is selectively moved into and away from physical contact with the first and second conducting contact, thereby creating and removing a conducting path between them.

Typically a push button switch has a bias structure, such as a spring or elastomeric member, which biases the movable bridge conductor to be at a resting position away from the first and second conducting contacts. The movable bridge conductor may be formed on, or integral with, the bias structure. When a manual force sufficiently strong to overcome an opposing force of the bias structure is applied to the movable bridge conductor, either directly or through a force translation member, such as a plunger, the movable bridge conductor is brought into contact with the first and second conducting contacts. This creates an electrical path between the first and second conducting contacts, thereby closing the switch.

The above-described push button switches require continuous application of an external force to maintain the movable bridge conductor in contact with the first and second conducting contacts. Another type of push button switch includes a latch mechanism which holds the movable bridge conductor against the first and second conducting contacts until an additional force disengages the latch, thereby permitting the bias mechanism to urge the bridge conductor member away from the contacts.

FIG. 1 shows a cross section of an example structure of a known type of push button switch. It will be understood that FIG. 1 is only an example, and is not necessarily drawn to scale, but it depicts a typical example of existing switch structures.

The FIG. 1 switch includes a first conducting contact 2 and a second conducting contact 4 arranged on a common insulating planar support 6. A guide structure 8 above or proximal to the first and second conducting contacts supports, by way of a through hole or channel (not numbered), a plunger or piston-type structure 10 movable in a direction S normal to the planar support, toward and away from the first and second conducting contacts. The through hole or channel is shaped to accommodate the cross section of the plunger 10, the desired clearance being small enough to support the plunger 10 and prevent it from rocking, but not so small that it binds the plunger from moving in the S direction. However, as described further below, the clearance frequently does not achieve the desired objective.

The guide structure may be part of a housing (not shown) formed specifically to enclose the plunger 10, or may be a portion of a housing (not numbered). An elastomeric bias member 12 is located above the first and second conducting contacts 2 and 4. A bridge conductor 14 is secured to a lower surface of the elastomeric bias member 12*a*.

FIG. 1 shows the elastomeric bias member 12 in its normal, non-deformed state, in which the bridge conductor is spaced above from the first and second contacts 2 and 4. It is assumed for this description that S is a downward direction pointing toward earth center. The lower plunger surface 10*a* therefore rests against upper surface 12*b* of the elastomeric bias member 12 due to the downward gravitational force on the plunger. Referring to FIG. 2, when an external force such as, for example, manual pressure is applied to the upper surface of the plunger it is forced downward in the S direction, thereby deforming the elastomeric bias member 12 as shown until the bridge conductor 14 contacts the first and second conducting contacts 2 and 4, thereby establishing an electrical path between the contacts. When the external force is removed the elastomeric bias member 12 returns to its FIG. 1 normal shape, thereby lifting the bridge conductor 14 from the first and second conductors 2 and 4 and opening the switch.

There are problems with the above-described general structure of push button and other contact-type switches. Significant among these problems is failure of the bridge conductor, such as the bridge conductor 14 shown in FIGS. 1 and 2, to establish a reliable, uninterrupted conducting path between the first and second conducting contacts 2 and 4.

The present inventors have identified at least two causes for the failure of the bridge conductor to establish a satisfactory electrical conducting path between conductors such as the contacts 2 and 4 of FIG. 1. In some instances debris may prevent proper electrical connection between one or both of the contacts 2 and 4 and the bridge conductor 14. Such debris may be adhering to the contacts 2 and 4, or to the bridge conductor 14, or may be freely moving within the switch to cause intermittent problems in response, for example, to mechanical vibration or other movement.

Referring to FIG. 3, another cause for improper electrical contact between the bridge conductor 14 and one or both of the contacts 2 and 4 is the bridge conductor 14 not aligning properly with the contacts 2 and 4. Misalignment typically results from lateral displacement of the plunger 10 in the X direction as shown in FIG. 3, or, more frequently, from the plunger 10 cocking at a THETA angle with respect to the plane of the contacts 2 and 4.

The cocking of the plunger 10 as shown in FIG. 3 is typically caused by, or results from, excessive clearance between the support channel 15 and the shaft 10*b* of the plunger 10. More particularly, manual push button and other plunger-actuated switches frequently include a mechanism that translates external force, such as a finger push, into a downward motion of the plunger 10. Referring to FIG. 5, an example of such a mechanism is the lever-mounted touch button 20, having a pivot point 22 and an actuating member 24. However, manufacturing tolerances, or mechanical wear, or both frequently cause the distal actuating surface 24*a* of the actuating member 24 to contact the upper surface of shaft 10*b* of the plunger 10 off-center, i.e., at a point not aligned with the plunger's center axis AXS. Such misalignment causes a torque moment to be applied to the plunger 10, which cocks the plunger to the THETA angle as shown in FIG. 3.

With continuing reference to FIG. 3, when the plunger 10 is cocked at the THETA position it typically fails to urge the movable bridge conductor, such as the example item 14, in an ideal direction or orientation toward conventional contacts such as items 2 and 4 of FIG. 1. This is illustrated by FIG. 4, which shows the switch mechanism depicted by FIG. 3 when the FIG. 5 button 20 is pressed further to deform the elastomeric member 12 and urge the bridge conductor 14 to close the switch. As can be seen in FIG. 3, the bridge conductor 14 is not flat against the two contacts 2 and 4. It will be understood that FIG. 4 shows only an instant in the motion history of the depicted plunger 10 as it is depressed. In actuality, the bridge conductor 14 may remain in the FIG. 4 orientation, or may rock so that it intermittently assumes the depicted orientation. Further, side-to-side motion of, for example, a person's finger on the touch button 20 of FIG. 5, or similar mechanism, may cause the FIG. 3 THETA angle to describe, for example, a cone-like region about the axis AXS. The motion will not result in an electrical connection between contact 2 and 4 when the button is pressed, or else the result may be an intermittent opening and closing of the switch while the button is continuously pressed.

FIG. 6 is a top elevation view of an example of an existing pattern for conductors such as items 2 and 4 of FIG. 1. The FIG. 6 pattern is an exemplar showing of a reason that for the misalignment depicted by FIGS. 3 and 4 will cause switch malfunction. The FIG. 6 pattern is referenced as a "three-finger" pattern, as it has a first conductor 32 having three parallel "fingers", labeled 32*a*, 32*b* and 32*c*, and a second conductor 34 having two parallel fingers, labeled 34*a* and 34*b*, interlaced with the fingers of 32. The first conductor 32 corresponds to the first contact 2 of FIG. 1, and the second conductor 34 corresponds to the second contact 4 of FIG. 1.

Overlaying the FIG. 6 top projection of the conductors 32 and 34 is a crosshatch pattern 36 showing a conductive contact footprint of an example implementation of a bridge conductor 14. The footprint 36 is of a bridge conductor typically referenced as a "pill" or a "gold pill", because of its shape and the fact that it is typical plated with gold for corrosion resistance. The center region bounded by the circle labeled 36*a* is hollow for resistance to debris and other mechanical reasons. FIG. 6 also shows the four bridge regions, labeled 38*a*, 38*b*, 38*c* and 38*d*, at which the bridge conductor 14, as implemented by a gold pill having the footprint 36, can bridge between a finger of the conductor 32 and a finger of conductor 34.

Basically, for the FIG. 6 switch to operate properly, both the condition of the footprint 36, and the misalignment shown by FIGS. 3 and 4 must be within the limit at which at least one of the bridge regions labeled 38*a* through 38*d* can be continuously bridged by the movable bridge conductor 14. If the misalignment, e.g., the magnitude of THETA, or the condition of the bridge conductor 14, i.e., the footprint 36, is beyond that limit, the switch may not operate properly.

FIGS. 7 and 8 are computer-generated printouts of test measurements showing the above-described effects of plunger misalignment. FIG. 7 shows the tested switching characteristics of a switch according to FIG. 1 having the FIG. 6 example standard conductor pattern, with a test fixture configured for aligned and centered depression of the plunger 10. The test fixture is labeled as item 70, with relevant portions of the tested switch labeled in accordance with FIG. 1. The test fixture 7—included a distance-force recorder (not shown) actuating the plunger 10, and a conduction meter (not shown) for measuring the resistance from the first conductor 2 to the second conductor 4 (not shown in FIG. 7). The plunger shaft 10*b* and support channel 15 were selected for non-excessive clearance, and the distance-force recorder force-exerting actuator (not shown) was carefully aligned such that its force FC was on-center with the axis AXS of the plunger 10.

With continuing reference to FIG. 7, graph plot FM is the force verses downward displacement plot, with the vertical axis VS representing the force exerted on the plunger 10 by the distance-force recorder, in Newtons, and the horizontal axis HS representing the displacement in the downward direction of the plunger 10. The maximum displacement is shown as MD, which was approximately 2.5 millimeters. Graph plot FM is the force versus position measurement. Graph plot SC is the switch conduction mode, with the vertical position OFF representing a measured open circuit between the conductors 2 and 4, and the vertical position ON representing a negligible resistance conduction path between the conductors 2 and 4.

As shown by graph FM, The distance-force recorder depressed and released the plunger 10 at a substantially constant rate, from zero to MD, which was approximately 2.5 millimeters, and then back to zero, in approximately eight to ten seconds. The maximum applied force was approximately two Newtons. The rates of depressing the plunger 10 and the pressures which the distance-force recorder exerted were selected to reasonable approximate a use in the switch's actual intended environment. Referring to FIG. 7, the test of the switch in the described set-up showed proper operation, with the SC plot showing clean, uninterrupted closing and opening of the switch at displacement positions substantially symmetric about the maximum displacement point MD.

As described, the FIG. 7 test was for a test fixture 70 carefully configured to apply force to the plunger 10 in a centered manner. This was predetermined to minimize, if not eliminate, any cocking as shown in FIG. 4. However, such an alignment, even if obtained for an actual switch, would likely cease as the clearance between the plunger shaft 10*b* and the channel 15 increased with use.

FIG. 8 is a measurement plot of relevant switching characteristics of a switch having the FIG. 6 example standard conductor pattern, with the test fixture 70 using a button mechanism 80 configured for off-center depression of the plunger. The FIG. 8 measurement more accurately simulated actual push-button switch such as the FIG. 1 example, than did the substantially artificial condition yielding the FIG. 7 test results. The FIG. 8 measurement clearly shows the intermittent contact between the bridge conductor 14 and the contacts 2 and 4 due to the cocking of the plunger 10. Instead of a clean turn-on, followed by a clean turn of the conduction path between contacts 2 and 4 as shown in FIG. 7, there is a first interruption labeled INT1, and a second interruption labeled INT2. As known to person skilled in the arts pertaining to electrical switches, such interruptions as the examples INT1 and INT2 may cause problems, and may require "debouncers" and other known electronic means to eliminate.

One potential solution to at least the alignment problem is to replace the plunger shown in FIG. 1 with another mechanism for actuating the bridge conductor 14 toward the contacts 2 and 4. An example is depicted by U.S. Pat. No. 6,201,202, issued Mar. 13, 2001, ("the '202 patent"). The '202 patent shows a hinged lever on which a bridging conductor is disposed, the lever and bridging conductor being arranged such that when the lever is depressed the conductor lies flat against two contacts, thereby connecting them.

The are many applications and requirements, though, for which a mechanism as shown by the '202 patent may be impractical or infeasible. For example, it requires a substantially different switch design and operation than the conventional plunger mechanism shown by FIG. 1. Further, it is foreseeable that manufacturing tolerances, and time-related factors such as wear of the bridge conductor, deterioration of the material constituting the lever, and debris could result in insufficient or intermittent contact between the bridge and the contacts.

SUMMARY OF THE INVENTION

The present invention advances the art and overcomes the above-identified shortcomings with push button and other plunger type switches, in addition to providing further benefits and features described herein.

A first example embodiment includes a first conductor on a substrate, the first conductor having an outer perimeter conductor extending along a perimeter line substantially circumscribing a path about a center, and a plurality of first fingers, each first finger extending from a respective position on the outer perimeter conductor substantially toward the center. A second conductor is arranged on the same substrate, the second conductor having an inner conductor substantially aligned with the center point, and having a plurality of second fingers, each second finger extending outward from the inner conductor between a respective pair of the first fingers. A first external electrical terminal is connected by a first conducting connection to the first conductor and a second external electrical terminal is connected by a second conducting connection to the second conductor.

A further aspect includes a support structure arranges above the first and second conductors, and a movable bridge conductor supported by the support structure to be movable between a first position where it does not make electrical contact with at least one of the first and second conductors, and a second position where it makes electrical contact with the first conductor and the second conductor, thereby establishing a conducting path between the first and second conductor.

In a still further aspect, the outward extending fingers include at least a first, a second, and a third outward extending finger, and the inward extending fingers include at least a first inward extending finger extending between the first and the second outward extending fingers, a second inward extending finger extending inward between the second and the third outward extending fingers, and a third inward extending finger extending inward between the third and the first outward extending fingers.

In a further aspect, an electrical conducting path is established between the first conductor and the second conductor by the movable bridge conductor being at the second position and contacting any conductor pair from a first pair, a second pair, a third pair, a fourth pair, a fifth pair and a sixth pair, the first pair consisting of the first inward extending finger and the first outward extending finger, the second pair consisting of the first inward extending finger and the second outward extending finger, the third pair consisting of the second inward extending finger and the second outward extending finger, the fourth pair consisting of the second inward extending finger and the third outward extending finger, the fifth pair consisting of the third inward extending finger and the second outward extending finger, and the sixth pair consisting of the third inward extending finger and the third outward extending finger.

Another aspect includes a bias mechanism for urging the movable bridge conductor toward the first position, and a movable translation member having an actuating surface for receiving an external force and an actuator surface for urging against the bias member, arranged such that an external force received at the actuating surface urges the actuator surface against the bias mechanism to move the movable bridge conductor to the second position.

In a still further aspect, the bias member is a resilient member arranged above the first conductor and the second conductor. The resilient member is arranged to cooperate with the actuator surface of the movable translation member and the movable bridge conductor such that it has a resting shape which locates the movable bridge conductor at the first position, and it assumes an actuated shape causing the movable bridge conductor to be at the second position when the actuating surface of the movable translation member receives a predetermined external force. The resilient member is further arranged and constructed such that upon a removal of the predetermined external force it returns to substantially the resting shape.

BRIEF DESCRIPTION OF THE DRAWINGS

The foregoing and other objects, aspects, and advantages will be better understood from the following description of preferred embodiments of the invention with reference to the drawings, in which:

FIG. 9 is a top elevation view of an example conductor pattern in accordance with a first example embodiment of the present invention;

FIG. 12 is a top elevation view of an example printed circuit board having two conductor patterns in accordance with the FIG. 9 embodiment, for implementing two plunger switches;

DETAILED DESCRIPTION OF THE EMBODIMENTS

FIG. 9 shows a top elevation view of a first example embodiment of this invention. The FIG. 9 example includes an outward radial conductor 40 and an inward radial conductor 42, each disposed on an insulating substrate, not shown, substantially co-located with each other but aligned such that they do not have electrical contact. The FIG. 9 example of outward radial conductor 40 includes an inner circumferential conductor 40*a* extending around a center point P, to partially enclose a center area CA, and a plurality of radially extending fingers 40*b*, each extending outward from the conductor portion 40*a*. Preferably, the respective bases 40*c* of the outward radially extending fingers 40*b* are substantially evenly spaced from one another along the conductor 40*a*. In the depicted example, one of the radially extending fingers, labeled 40*b*', extends to connect to a first switch terminal 46. The remaining radially extending fingers 40*b* extend to terminate at respective locations along a reference perimeter CR.

The inward radial conductor 42 includes an outer circumferential conductor 42*a* extending substantially around, but outside of, the reference perimeter CR. A plurality of inward extending fingers 42*b* extend inward from respective positions along the outer circumferential conductor 42*a*, each finger 42*b* extending between, but not contacting, a respective pair of the radially extending fingers 40*b* of the outward radiating finger conductor.

Optionally, one of the inward extending fingers 42*b* extends through the gap GP1 of the inner conductor 40*a*, and terminates at a center conductor 42*c* arranged in the center area CA, without contacting the conductor 40*a*.

Figure 1:
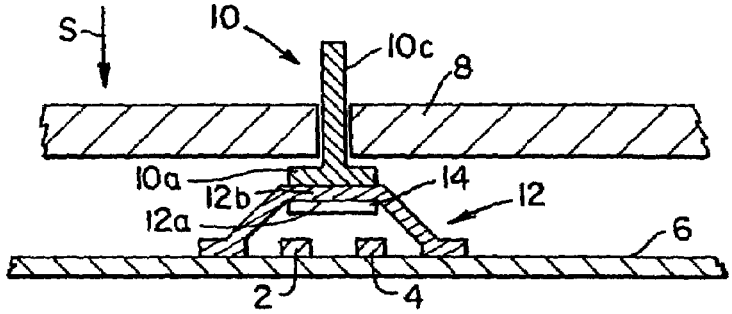
FIG. 1 shows a cross-sectional view of an example prior art plunger switch.
Figure 2:
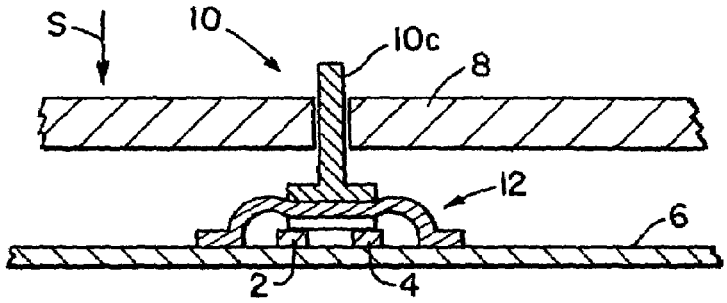
FIG. 2 shows the FIG. 1 example plunger switch with its plunger depressed to close the switch.
Figure 3:
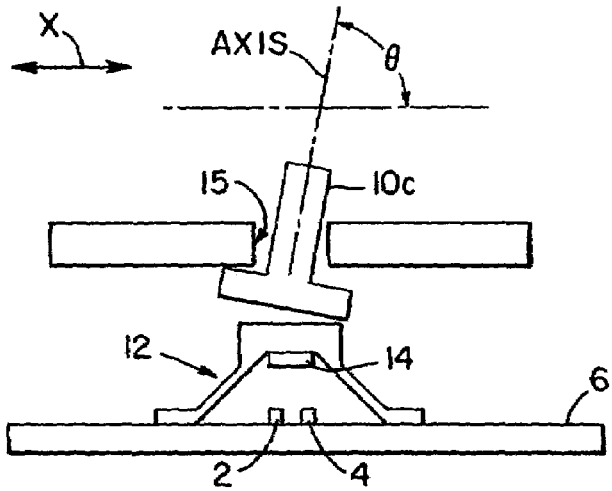
FIG. 3 shows a cross-sectional view of example plunger misalignment of a plunger switch of the example type depicted by FIG. 1.

Preferably the upper surface of the outward radial conductor 40 and the inward radial conductor 42 is gold-plated, for a reliable, highly conductive corrosion-resistant contact with a bridge conductor such as the bridge conductor 14 of FIG. 1.

Figure 10:
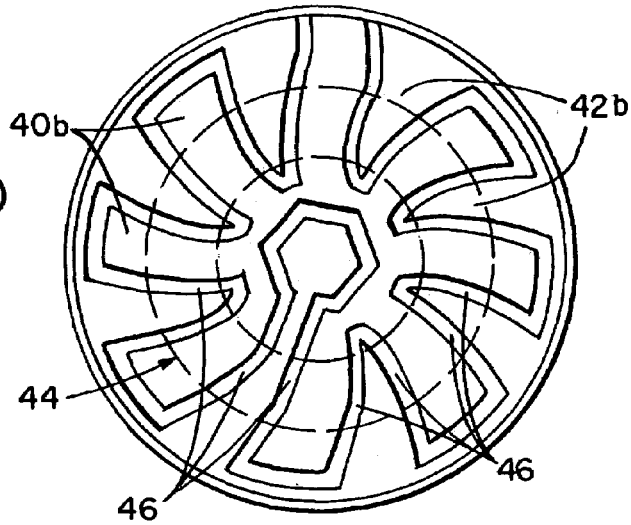
FIG. 10 shows the example pattern of input and output conductors of the FIG. 9 example embodiment with an overlay of a movable bridge conductor footprint, and a diagram of its significantly greater number of available bridges between its input conductor and the output conductor as compared to that provided by the conductors of FIG. 6.
Figure 7:
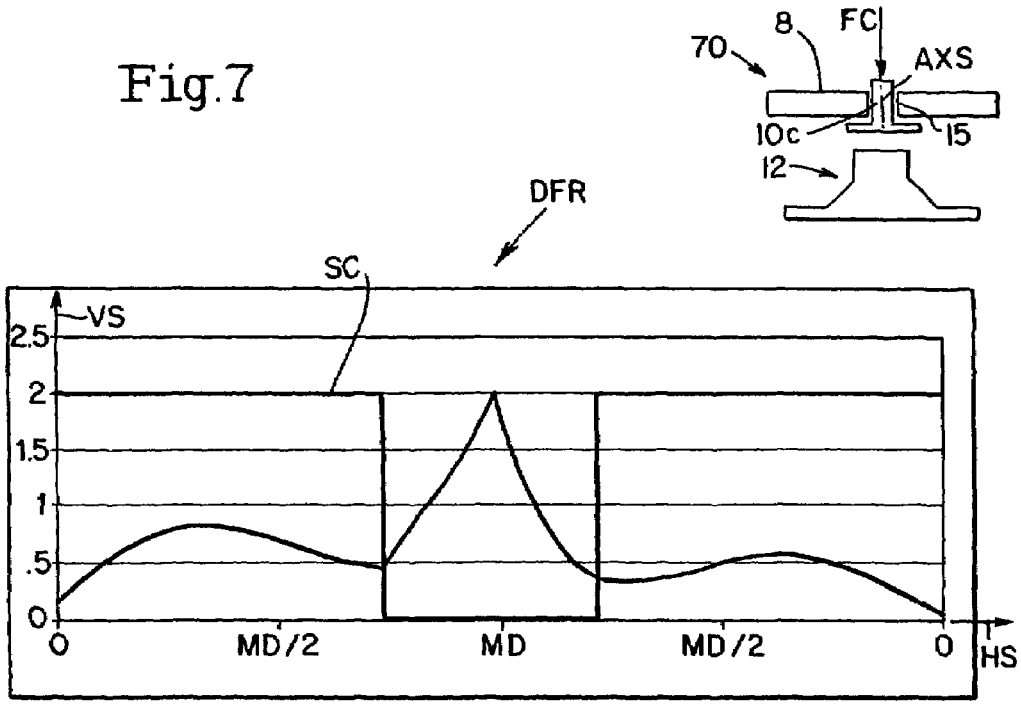
FIG. 7 is measurement plot of relevant switching characteristics of a switch having the FIG. 6 example standard conductor pattern, with the test fixture configured for aligned and centered depression of the plunger.

FIG. 10 shows the FIG. 9 example pattern of conductors 40 and 42, with diagramed region 44 representing a sample contact footprint of a typical "pill" or "golden pill" variety of bridge conductor 14 as used for FIG. 1. The footprint region 44 therefore may be exactly the same as that shown as item 36 in FIG. 6. Labeled as 46 are each of the bridge regions, which are locations where a direct bridge conduction from one of the fingers 40*b* to one of the finger 42*b* can be formed by a typical "pill" or "golden pill" variety of bridge conductor 14 described above. As can be seen from FIG. 10, the plurality of eight outward extending fingers 40*b* and eight inward extending fingers 42*b* creates sixteen bridge regions 46. The number sixteen only counts the direct bridges. Actually, the number of potential bridges, i.e., where a bridge conductor such as item 14 could contact at least one of the outward extending fingers 40*b* and at least one of the eight inward extending fingers, is considerably higher than sixteen.

Figure 6:
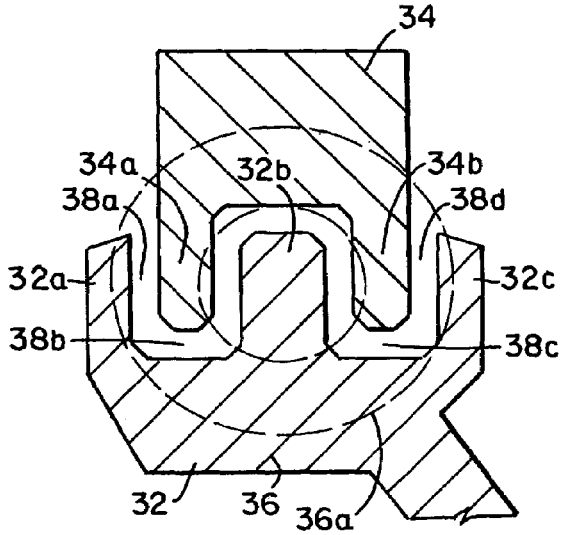
FIG. 6 is a top elevation view of a standard conductor pattern used within plunger switches in accordance with, for example, FIG. 1.

Comparing FIG. 10 to FIG. 6, it is seen that a dramatic improvement is obtained in both the number of, and spatial distribution of, the bridge regions obtained with the radial conductors 40 and 42. Referring to FIG. 10, it can be seen that, for example, the bridge conductor 14 will maintain an electrical bridge between the conductor 40 and 42 even with a rocking or other motion of the bridge conductor 14 precessing the THETA angle to substantially any position around such a cone. Stated differently, at substantially any such position or cocked orientation an electrical bridge is likely because the bridge conductor 14 will likely contact at least one of the sixteen depicted bridge regions 46 located around the footprint 44.

Figure 4:
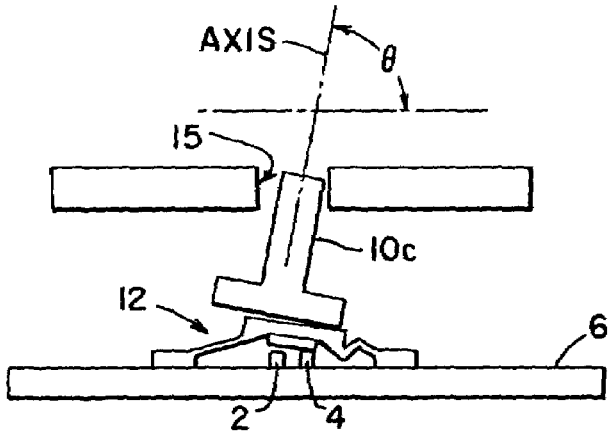
FIG. 4 depicts a misalignment further to that illustrated by FIG. 3 when the plunger is depressed to a nominally closed position.
Figure 5:
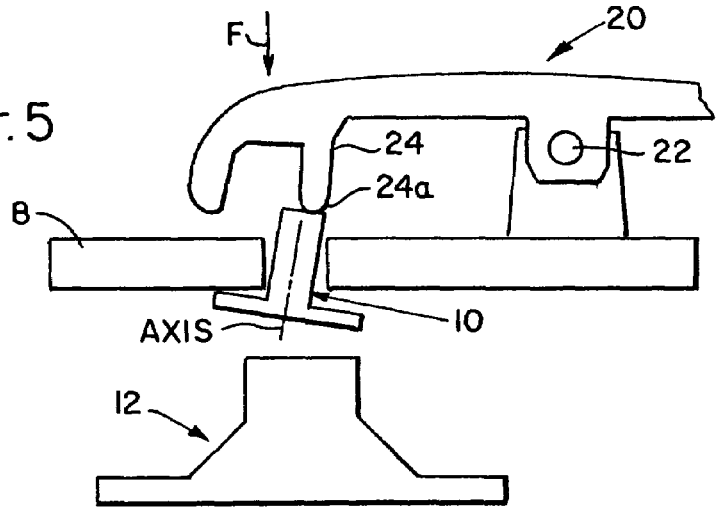
FIG. 5 shows an example button mechanism for transferring a manual pressing force into depression of the plunger.
Figure 11:
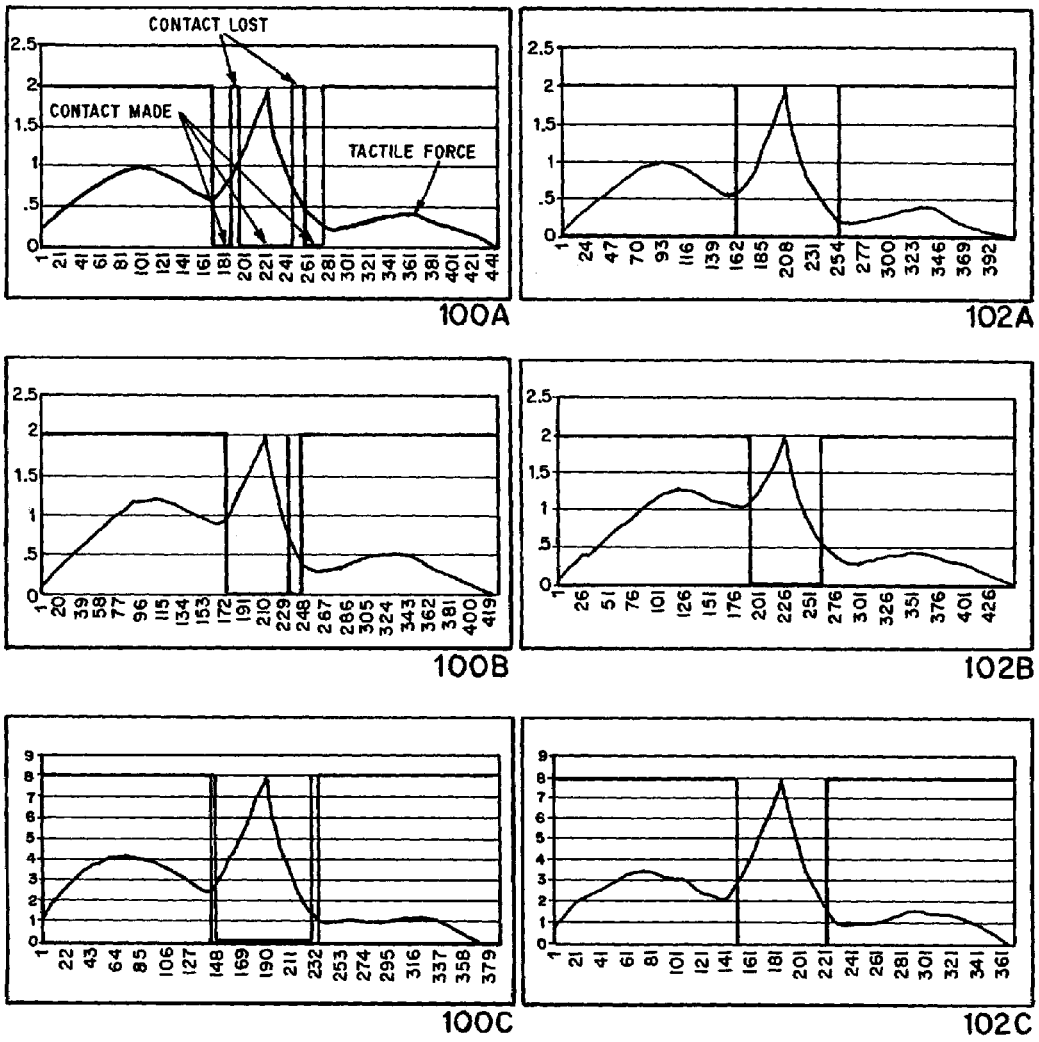
FIG. 11 shows a measurement plot of switching characteristics of each of three switches having an existing art conductor pattern, and a measurement plot of switching characteristics of each of five switches having a conductor pattern in accordance with FIG. 9.

FIG. 11 shows test results, labeled 100A through 100C, for a random sample of three switches having an existing "three-finger" conductor pattern as shown by FIG. 4, and test results, labeled 102A through 102C, for a random sample of three switches, selected from a larger lot, having the pattern depicted by FIG. 9. Each of the tests was conducted according to the test described in reference to FIG. 8. The test conditions, including the specific golden pill implementation for the bridge conductor 14, were the same for the tests of each of the switches. It is seen from plots 100A through 100C that each of the three samples having the existing conductor pattern of FIG. 6 exhibits intermittent switch operation, reflecting repeated loss of electrical contact between the bridge conductor 14 and the conducting contact 2 and 4. In contrast, it is seen from tests 102A through 102C that each of the switches having the FIG. 9 example conductor pattern exhibited ideal switch characteristics, switching from OFF to ON and back to OFF, with clean transitions and no intermittent loss of conduction.

Figure 8:
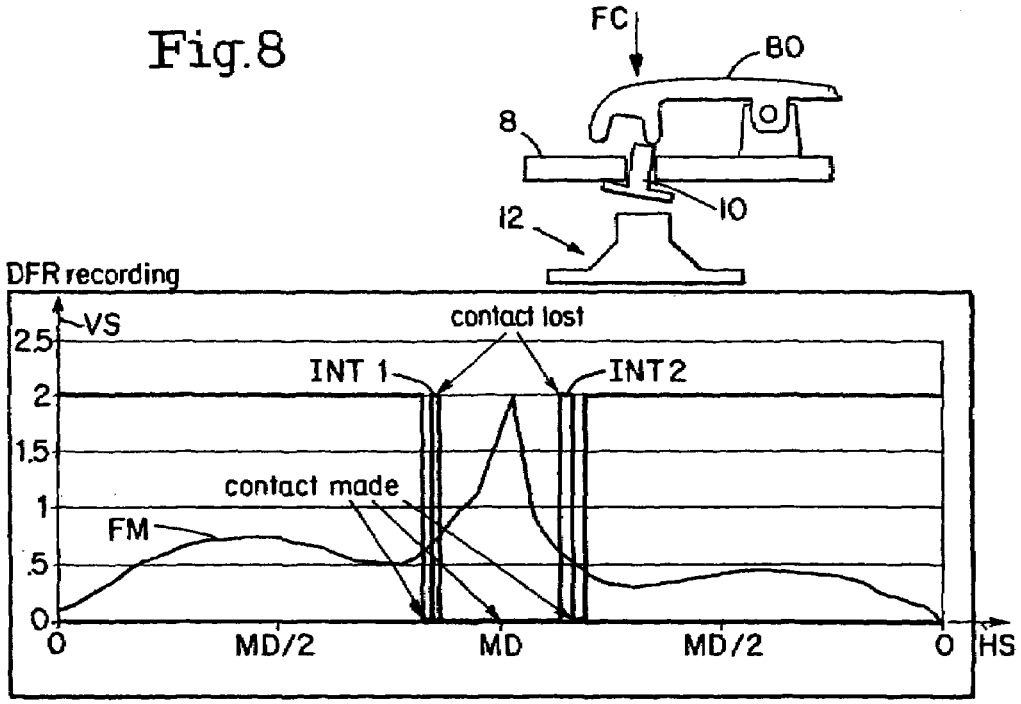
FIG. 8 is a measurement plot of relevant switching characteristics of a switch having the FIG. 6 example standard conductor pattern, with the test fixture configured for off-center depression of the plunger, simulating actual use.

FIG. 12 shows an example printed circuit board 120 having two conductor pairs, labeled 122 and 124, respectively, arranged on a PCB substrate 126, each being in general accordance with FIG. 8. An example dimension DMTR is 5.0 millimeters.

Figure 13:
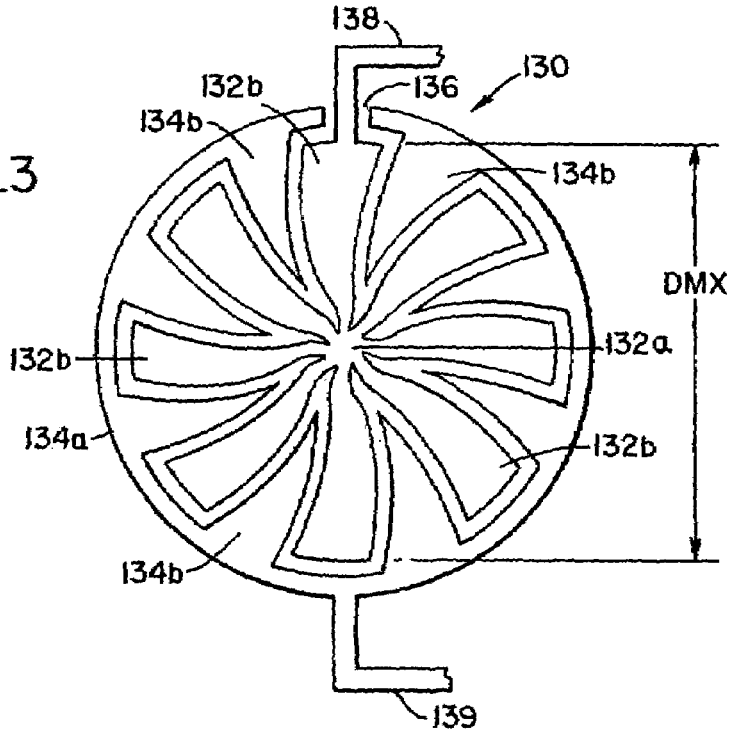
FIG. 13 shows a second example embodiment of a conductor pattern in accordance with the present invention.

FIG. 13 shows a second example embodiment of a switch contact conductor pair in accordance with the objectives of the present invention. The FIG. 13 conductor pair 130 includes an outward radial conductor 132 having a center conductor 132*a*, and having a plurality of outward radially extending fingers 132*b*, each extending outward from the center conductor 132*a* in a generally radial trace with a fan-like radius of curvature RHX. An example RHX is 9.0 millimeters. The RHX curvature is preferred but not required. The FIG. 13 conductor 130 further includes an inward radial conductor 134 having an outer perimeter conductor 134*a* and a plurality of inward radially extending fingers 134*b*, each extending between a corresponding pair of adjacent ones of the outward extending fingers 132*b*. An example DMX dimension is 3.5 millimeters. A gap 136 is formed in the perimeter conductor 134*a* and a first external conductor lead 138 extends through the gap 136 and connects to the outward radially extending finger 132*b*'. A second external conductor lead 139 connects to at least one location on the perimeter conductor 134*a*.

The FIG. 13 example embodiment differs from the FIG. 9 example embodiment by the outward radially extending fingers 132*b* extending from a solid center conductor 132*a*. The outward radially extending fingers 40*b* of FIG. 8 extend from an inner conductor 40*a* which is a partially closed conductor trace about the center point P, and one of the inward radially extending fingers 42*b* extends to a solid conductor arranged interior of the inner conductor 40*a*. The FIG. 13 example embodiment also preferably curves each of the outward radially extending fingers 132*b* and each of the inward radially extending fingers 134*b* about a radius of curvature RHX.

Figure 14:
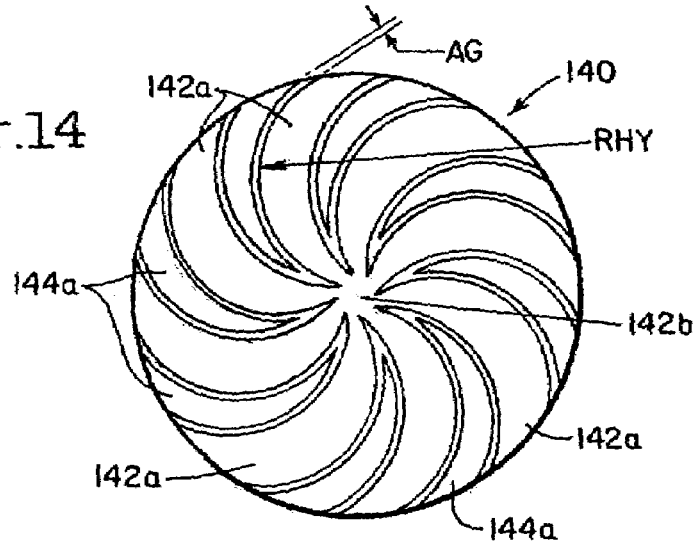
FIG. 14 shows a third example embodiment of a conductor pattern in accordance with the present invention.

FIG. 14 shows as item 140 a third example embodiment of a switch contact conductor pair in accordance with the objectives of the present invention. The FIG. 14 example embodiment is similar to that depicted by FIG. 13, but has a plurality of outward radially extending fingers 142*a* extending outward from a convergence point 142*b* in a more pronounced semi-helical pattern, each finger curved about a radius of curvature RHY. An example RHY is 9.0 millimeters. A plurality of inward radially extending fingers 144*a* is arranged such that each finger 144*a* extends between a corresponding pair of adjacent ones of the outward extending fingers 142*b*. The air gap AG between each finger 142*a* and 144*a* is, for example, 0.2 millimeters.

Figure 15:
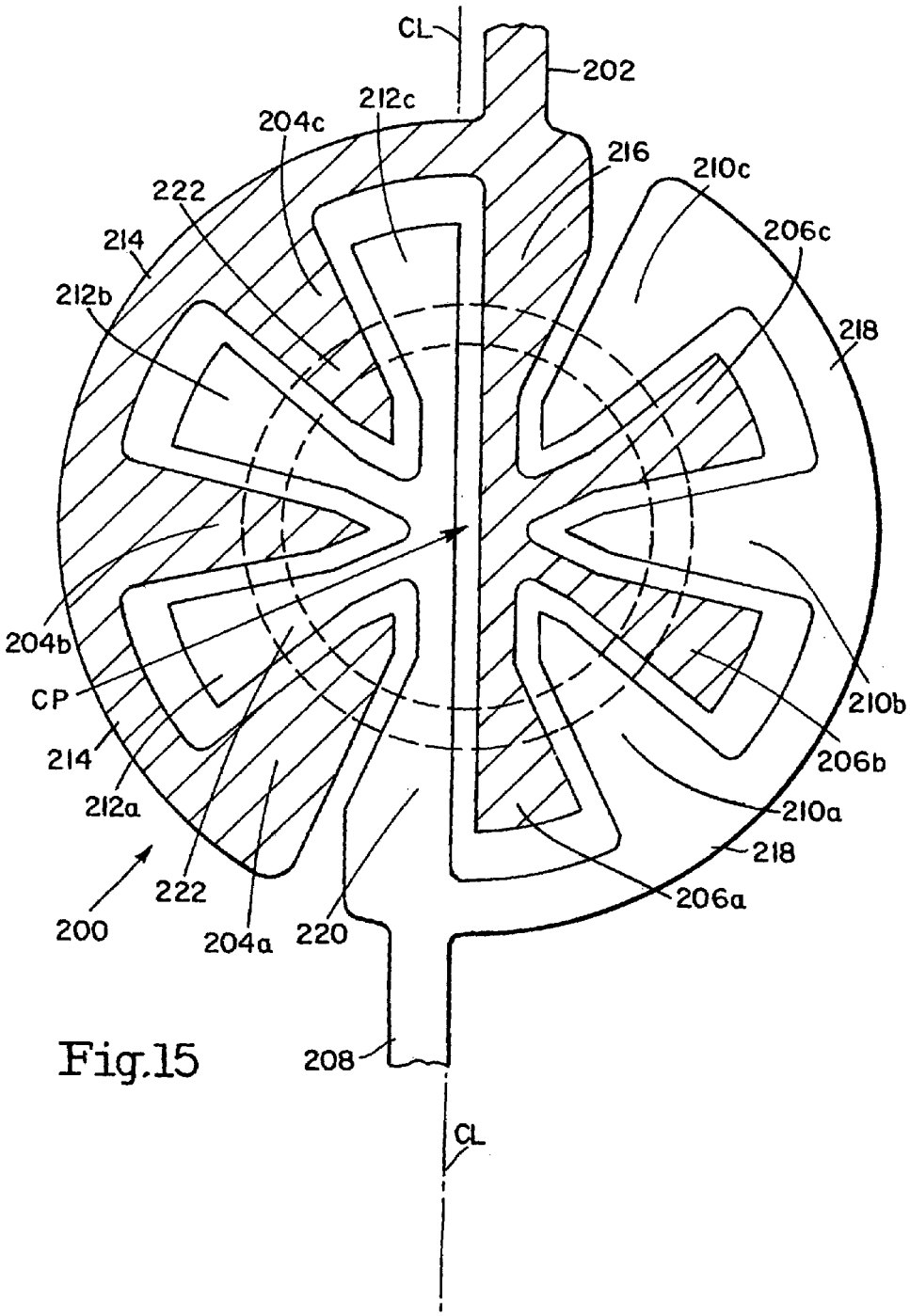
FIG. 15 shows another example embodiment of a conductor pattern in accordance with the present invention.

FIG. 15 shows as item 200 another example of a switch contact conductor pair in accordance with the objectives of the present invention. The FIG. 15 example has a first conductor network, shown in cross-hatch, beginning at terminal 202 and having both inward extending fingers 204*a*–204*c* and outward extending fingers 206*a*–206*c*, and a second conductor network beginning at terminal 208 and having, in an arrangement complementary to that of the first conductor network, both inward extending fingers 210*a*–210*c* and outward extending fingers 212*a*–212*c*. The inward extending fingers 204*a*–204*c* of the first network extend inward, toward a center point CP, from a first network outer conductor 214, which extends approximately halfway around a center point CP. The outward extending fingers 206*a*–206*c* of the first conductor network extend outward, in a direction radial from the center point CP, from a first network center conductor 216, which in the depicted FIG. 15 example extends substantially along a bifurcating reference line CL. The inward extending fingers 210*a*–210*c* of the second network extend inward, toward the center point CP, from a second network outer conductor 218, which extends approximately halfway around the center point CP in an arrangement that substantially mirrors the first network outer conductor 214. The outward extending fingers 212*a*–212*c* of the second conductor network extend outward, in a direction radial from the center point CP, from a second network center conductor 220, which in the depicted FIG. 15 example extends substantially along the bifurcating reference line CL parallel to the first network inner conductor 216.

As seen in the FIG. 15 example, the three inward extending fingers 204*a*–204*c* of the first conductor network are interleaved with the three outward extending fingers 212*a*–212*c* of the second conductor network on one side of the reference line CL, and the three outward extending fingers 206*a*–206*c* of the first conductor network are interleaved with the three inward extending fingers 210*a*–210*c* of the second conductor network on the other side of the reference line CL. This pattern provides a circumferential contact region 222 for a switch conductor such as, for example the switch conductor 14 of FIG. 1.

Referring to FIG. 15, it will be understood that the semi-circular arrangement of the outer conductors 214 and 218 is only for purposes of example. The FIG. 15 embodiment also contemplates elliptical or semi-rectangular paths of the outer conductors 214 and 218. Further, the number of inner extending conductors 202*a*–202*c* of the first conductor network and the number of outward extending conductors 212*a*–212*c* of the second conductor network being three, and the similar plurality of three conductors 204*a*–204*c* and three conductors 214*a*–214*c* is only for purposes of example.

The examples depicted by FIGS. 9, 13 and 14 each have eight outward extending fingers, such as 40*b* of FIG. 9, and eight inward extending fingers, such as 42*b* of FIG. 9. As described, the example number eight provides sixteen bridge regions 46, substantially evenly distributed about the footprint circle 44 as described in reference to FIG. 10. The number eight, however is only an example of the present conductor pattern. Other numbers, ranging for example from as few as three or four through as many as twelve or more, are contemplated. A general guideline for selection of the number is that the outward extending fingers 40*b* and preferably extend in a generally radial pattern, with the number selected being such to create a sufficient number of bridge regions, such as the sixteen shown in FIG. 10, to achieve the objective of reliable switch operation.

The above-described example implementation of a movable bridge conductor 14 is a golden pill, as this is a known structure that works well with conductors such as shown by FIGS. 9, and 12–15, and is readily secured to a bias member such as the elastomeric bias member 12. Other structures and materials for the bridge conductor may be used as well. One example is graphite-impregnated rubber.

The above-described example substrate 126 is a printed circuit board (PCB), which may be formed of any material and have structure that is known in the PCB arts. The substrate 126 being a PCB is only for purposes of example. The substrate 126 may have any other structure and material capable of supporting the conductors 40 and 42 against the mechanical forces of operation described herein, and withstanding the environmental conditions in which the mechanism will be used. Selection of such structures and materials is readily made by persons of ordinary skill in the industrial arts relating to the design and production of electrical switches.

The invention has been described with reference to example embodiments and, therefore, it should be understood that various substitutions, variations, and modifications may be made thereto without departing from the scope of the invention as defined in the appended claims.

Having thus described our invention, what we claim as new and desire to secure by Letters Patent is as follows:

1. A switch conductor comprising:

a substrate;

a first conductor arranged on said substrate, said first conductor having an outer conductor extending along a first substantially circumferential reference line extending around a center point, and having a plurality of first fingers having a tapered shape, each first finger extending substantially toward said center point from a respective position on said outer conductor; and a second conductor arranged in said substrate, having an inner conductor substantially aligned with said center point and having a plurality of second fingers, each second finger extending from said inner conductor between a respective pair of said first fingers and having a taper substantially opposing that of adjacent first fingers.

2. A switch conductor according to claim 1, wherein the outward extending fingers include at least a first outward extending finger, a second outward extending finger, and a third outward extending finger, and the inward extending fingers include at least a first inward extending finger extending between the first and the second outward extending fingers, a second inward extending finger extending inward between the second and the third outward extending fingers, and a third inward extending finger extending inward between the third and the first outward extending fingers.

3. The switch conductor according to claim 1, wherein said first and second fingers have substantially opposed curves.

4. The switch according to claim 3, wherein the curves are in the shape of a portion of a spiral.

5. A switch comprising:

a substrate;

a first conductor arranged on said substrate, said first conductor having an outer conductor extending along a first substantially circumferential reference line extending around a center point, and having a plurality of first fingers having a tapered shape, each first finger extending substantially toward said center point from a respective position on said outer conductor;

a second conductor arranged in said substrate, having an inner conductor substantially aligned with said center point and having a plurality of second fingers, each second finger extending from said inner conductor between a respective pair of said first fingers and having a taper substantially opposing that of adjacent first fingers;

a support structure arranged above the first and second conductors;

a movable bridge conductor supported by the support structure to be movable between a first position where said movable bridge conductor does not make electrical contact with at least one of the first and second conductors, and a second position where said movable bridge conductor makes electrical contact with the first conductor and the second conductor, thereby establishing a conducting path between the first and second conductor.

6. A switch according to claim 5, wherein the outward extending fingers include at least a first outward extending finger, a second outward extending finger, and a third outward extending finger, and the inward extending fingers include at least a first inward extending finger extending between the first and the second outward extending fingers, a second inward extending finger extending inward between the second and the third outward extending fingers, and a third inward extending finger extending inward between the third and the first outward extending fingers.

7. A switch according to claim 6, wherein an electrical conducting path is established between the first conductor and the second conductor by the movable bridge conductor being at the second position and contacting any conductor pair from a first pair, a second pair, a third pair, a fourth pair, a fifth pair and a sixth pair, the first pair consisting of the first inward extending finger and the first outward extending finger, the second pair consisting of the first inward extending finger and the second outward extending finger, the third pair consisting of the second inward extending finger and the second outward extending finger, the fourth pair consisting of the second inward extending finger and the third outward extending finger, the fifth pair consisting of the third inward extending finger and the second outward extending finger, and the sixth pair consisting of the third inward extending finger and the third outward extending finger.

8. A switch according to any of claims 5 through 7, further comprising:

a bias member for urging the movable bridge conductor toward the first position, and a movable translation member having an actuating surface for receiving an external force and an actuator surface for urging against the bias member, arranged such that an external force received at the actuating surface urges the actuator surface against the bias mechanism to move the movable bridge conductor to the second position.

9. A switch according to any of claims 5 through 7, further comprising:

a bias member for urging the movable bridge conductor toward the first position, and a movable translation member having an actuating surface for receiving an external force and an actuator surface for urging against the bias member, arranged such that an external force received at the actuating surface urges the actuator surface against the bias mechanism to move the movable bridge conductor to the second position, wherein the bias member is a resilient member arranged above the first conductor and the second conductor to cooperate with the actuator surface of the movable translation member and the movable bridge conductor such that it has a resting shape which locates the movable bridge conductor at the first position, and when the actuating surface of the movable translation member receives a predetermined external force the resilient member is urged to an actuated shape wherein the movable bridge conductor to be at the second position.

10. The switch according to claim 5, wherein said first and second fingers have substantially opposed curves.

11. The switch according to claim 10, wherein the curves are in the shape of a portion of a spiral.

12. A switch conductor comprising:

a substrate; and a pair of interleaved conducting contacts having a plurality of outward radially extending conductors, the conductors having a tapered shape opposed to adjacent conductors.

13. The switch according to claim 12, wherein said opposed tapered shaped conductors further have substantially opposed curves.

14. The switch according to claim 13, wherein the curves are in the shape of a portion of a spiral.

15. A switch conductor comprising:

a substrate;

a first plurality of first conductors extending radially outward from a center reference point, each conductor terminating at a respective distal end and having a wider cross-section at the distal end than a cross-section at the center reference point;

a circumferential conductor extending from a first location to a second location on a perimeter circumscribing said respective distal ends; and a plurality of second conductors extending radially inward from said circumferential conductor, each of said second conductors extending between an adjacent pair of said first conductors and having a shape to form a substantially uniform space between adjacent pair of first and second conductors.

16. The switch conductor according to claim 15, wherein each conductor further has a spiral curve.

17. A switch conductor comprising:

a substrate;

a first plurality of first conductors arranged on said substrate, each extending from a common conductor, outward from a common center reference, in a respectively different radial direction, each first conductor terminating at a respective distal end and having a narrower cross-section at the common center reference than a cross-section at the distal end;

a circumferential conductor arranged on said substrate, extending from a first location to a second location on a perimeter circumscribing said respective distal ends; and a plurality of second conductors arranged on said substrate, extending radially inward from said circumferential conductor, each of said second conductors extending between an adjacent pair of said first conductors and having a shape substantially opposed to the adjacent conductors.

18. The switch conductor according to claim 17, wherein said first and second conductors have opposed curves.

19. A switch comprising:

a substrate;

a plurality of first conductors arranged on the substrate;

a plurality of second conductors are arranged such that a plurality of air gaps extend substantially outward from a center reference point, each of said plurality of air gaps bounded on one side by a respective one of said first conductors and on the other side by a respective one of said second conductors, said first and second conductors having substantially opposed tapering shapes;

a support structure arranged above plurality of air gaps;

a movable bridge conductor supported by said support structure to be movable between a first position where said movable bridge conductor makes contact with at least one of said first conductors and at least of said second conductors and a second position to bridge across at least one of said air gaps, and a second position where said movable bridge conductor does not bridge any of said air gaps.

20. The switch conductor according to claim 19, wherein said first and second conductors have opposed curves.

* * * * *